United States Patent [19]

Bush

[11] Patent Number: 4,484,700

[45] Date of Patent: Nov. 27, 1984

[54] DEVICE FOR USE IN CARRYING A CHILD

[76] Inventor: Sydney J. Bush, 37 Westella Rd., North Humberside, Kirkella Hull, England

[21] Appl. No.: 549,005

[22] Filed: Nov. 3, 1983

Related U.S. Application Data

[63] Continuation of Ser. No. 286,191, Jul. 23, 1981, abandoned.

[30] Foreign Application Priority Data

Jul. 25, 1980 [GB] United Kingdom ..... 8024451

[51] Int. Cl.[3] ..... A45F 3/26

[52] U.S. Cl. ..... 224/161; 224/159; D3/31

[58] Field of Search ..... 224/153, 154, 155, 156, 224/158, 159, 160, 161, 901, 210, 261, 265, 266, 272; D3/31, 32

[56] References Cited

U.S. PATENT DOCUMENTS

| | | | |
|---|---|---|---|
| D. 252,176 | 6/1979 | Mallien et al. | D3/32 |
| 2,197,427 | 4/1938 | Despain | D3/32 |
| 2,560,406 | 7/1951 | Bergsland | 224/210 |
| 3,097,773 | 7/1963 | Cunningham | 224/161 |
| 3,368,725 | 2/1968 | Martin | 224/155 |
| 3,421,670 | 1/1969 | Hansson | 224/161 |
| 3,610,489 | 10/1971 | Parsons | 224/161 |
| 3,698,608 | 10/1972 | Entwistle | 224/159 |
| 3,968,910 | 7/1976 | Dye et al. | 224/161 |
| 4,139,132 | 2/1979 | Fairchild, Jr. | 224/265 |
| 4,217,998 | 8/1980 | Alexander | 224/210 |
| 4,402,441 | 9/1983 | Jones et al. | 224/265 |

FOREIGN PATENT DOCUMENTS

| | | | |
|---|---|---|---|
| 167146 | 11/1950 | Austria | 224/160 |
| 2076636 | 6/1980 | Canada | 224/153 |
| 882,484 | 6/1943 | France | 224/153 |
| 896512 | 5/1944 | France | 224/161 |
| 61077 | 7/1939 | Norway | 224/161 |
| 67375 | 1/1944 | Norway | 224/161 |
| 70767 | 5/1944 | Norway | 224/161 |
| 68033 | 7/1944 | Norway | 224/161 |
| 907687 | 10/1962 | United Kingdom | 224/160 |

*Primary Examiner*—Allan N. Shoap
*Assistant Examiner*—David Fidei

[57] ABSTRACT

A device to be worn by an individual for use in supporting a child or infant to be carried seated on the shoulders of the wearer comprises a backrest for providing rearward and lateral support for the child, a bracing means for engagement against the rear of the torso of the wearer and a lever structure interconnecting said bracing means and said backrest, said structure extending forwardly and upwardly below the arms of the wearer and in front of the shoulders before passing behind the shoulders to the backrest, whereby the structure utilizes the frontal shoulder region of the adult as a fulcrum to transfer a rearward load on the backrest to the said bracing means.

9 Claims, 4 Drawing Figures

DEVICE FOR USE IN CARRYING A CHILD

This application is a continuation of application Ser. No. 286,191, filed July 23, 1981, now abandoned.

BACKGROUND OF THE INVENTION

The invention relates to a device to be worn by an individual for use in supporting a child or infant to be carried seated on the shoulders of the wearer.

Devices for use in carrying children have hitherto been proposed in a variety of kinds. In one well-known arrangement, the child is arranged to be supported in a sling or harness worn on the back of an adult so that the child is carried papoose fashion. Such an arrangement is, however, suitable only for relatively small children and infants, and, since the weight of the child is located entirely behind the back of the wearer, the load placed on the torso of the wearer is uncomfortable.

Children have also traditionally been carried by adults in so-called piggy-back fashion, namely seated astride the adults shoulders. This normally requires the adult to provide additional rearward support for the child to prevent it falling, and devices have been proposed to provide such support for a child to be carried in this manner, so that the hands of the adult are left free. One such device, for example, is shown in U.S. Pat. No. 3,986,910 and comprises a backrest means arranged to provide rearward and lateral support for a child seated on the shoulders of an adult, the backrest means being interconnected with bracing means arranged to engage against the back of the adult. Such an arrangement is developed from a framework of the kind worn to support a rucsac or back-pack, and needs to be supported on the torso of the wearer by means of a shoulder harness. Thus the device is not only relatively cumbersome to wear and of relatively complicated and expensive construction, but also is not ideally suited to providing support for the child, since the rearward and lateral support necessary to locate a child whose weight is supported on the adults shoulders differs significantly from that necessary to support the traditional rucsac or back-pack, which comprises a load located behind the back of the adult and to the rear of the shoulders.

SUMMARY OF THE INVENTION

It is an object of the present invention to provide a device for use in supporting a child or infant to be carried on the shoulders, which device is of simple construction and provides more effective support than hitherto known devices of the kind referred to above.

The invention accordingly provides a device to be worn by an individual for use in supporting a child or infant to be carried seated on the shoulders of the wearer, comprising, backrest means adapted to provide rearward and lateral support for the child, bracing means for location against the rear portion of the torso of the wearer of the device, and means interconnecting said backrest means and said bracing means and adapted to be supported on the torso of the wearer, characterised in that the said interconnecting means comprises a lever system arranged to extend from said bracing means forwardly below the arms of the wearer and then upwardly and rearwardly over the shoulders whereby the frontal shoulder region of the wearer's body forms a fulcrum for said lever system and rearward forces placed upon said backrest means by the child tend to exert a turning movement upon said lever system which is resisted by the engagement of said bracing means against the rear of the torso of the wearer.

The arrangement in accordance with the invention takes account of the fact that the supplementary support needed by a child seated upon an adult's shoulders does not involve support for a substantial load, but merely requires sufficient force to prevent rearward overbalancing of the child whose natural tendency is to attempt to balance itself upon the adult's shoulders. Thus the use of a lever structure which in accordance with the invention bears upon the frontal region of the adult's shoulders enables the required support to be provided by means of a relatively simple and lightweight structure so that the cumbersome back-pack frame and shoulder harness of the known devices can be eliminated. This not only substantially simplifies and reduces the cost of the child supporting device, but also leaves the rear and back of the adult's shoulders unobstructed so that the device can comfortably be worn, for example whilst seated in a chair or the like.

The framework of the lever system of the device in accordance with the present invention may be formed of rigid or semi-rigid material such as light gauge metal wire or tubing, or could be formed by molding from synthetic plastics material of appropriate cross section. The device may comprise a one-piece, relatively rigid frame, or may incorporate resilient or jointed portions allowing folding of the device for storage. In any event the portions of the device forming the lever system and extending frontally of the shoulders of the wearer must be sufficiently rigid to enable the appropriate lever function to be obtained, and thus the lever system preferably includes two spaced, relatively rigid limbs extending between ends of said backrest and said bracing means respectively.

According to a further preferred feature of the present invention the said limbs are shaped to conform to the anatomy of the adult and include portions curved to extend over the tops of the shoulders in order to provide vertical support for the device, the arrangement further being such that the top of each shoulder forms a further fulcrum for the lever system whereby lateral forces placed on said backrest means exert a turning movement which is resisted by engagement of the lever system against the lateral portion of the torso below the wearers arms.

DETAILED DESCRIPTION OF THE INVENTION

Figure 1:
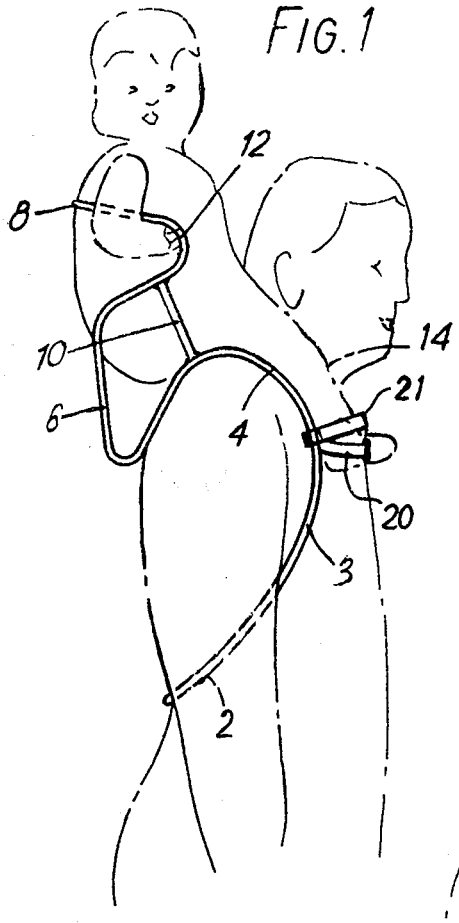
FIG. 1 is a side view of a device in accordance with the invention, as seen in use, with the positions of the wearer of the device and a child or infant shown in broken lines.
Figure 2:
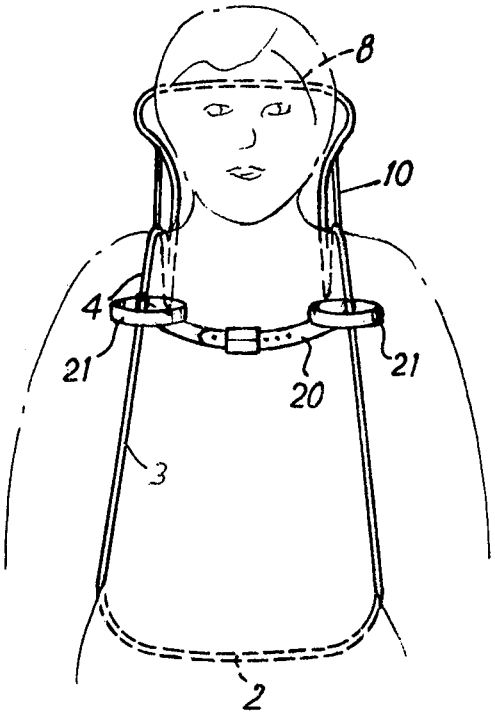
FIG. 2 is a front view corresponding to FIG. 1.
Figure 3:
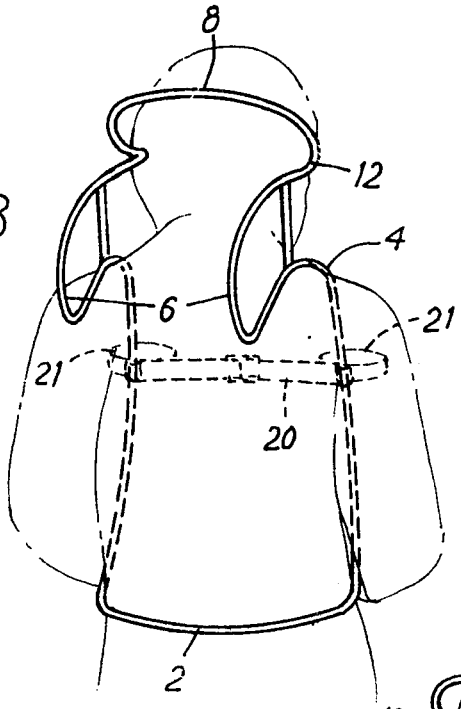
FIG. 3 is a three quater view from the rear of the device as shown in FIG. 1.

Referring to the drawings, a device in accordance with the invention comprises, in its simplest form, a one-piece framework of rigid or semi-rigid material, typically 4 mm mild steel wire provided with an outer covering of synthetic plastics material such as polyvinyl chloride. The framework comprises a bracing portion 2 arranged to extend across the rear back of the adult and two lateral relatively rigid limbs 3 of the framework extend upwardly and forwardly below the arms of the wearer to pass across the front shoulder region as indicated at 4. The limbs 3 are then formed into two rearwardly projecting loops 6 and finally terminate at the ends of a backrest means including a rear portion 8 and a lateral portion 12, for providing rearward and lateral support respectively for a child which may be seated upon the adult's shoulders as indicated at 14. Reinforcing strips 10, for example of synthetic plastics material, serve to prevent bending of the frame to open the loops 6 and thus rigidify the limbs 3.

It will be noted that although the framework described is of resilient or semi-rigid material, so that it may be accommodated to the anatomy of the wearer, it effectively forms a structural lever system wherein rearward forces placed on the portion 8 of the backrest tend to cause a pivoting movement about a fulcrum formed by the frontal shoulder portion of the adult in the region 4, whereby such forces are transmitted to the rear torso of the adult by means of the portion 2. Furthermore, lateral forces on the portion 12 of the backrest will similarly tend to cause tilting of the framework about the upper shoulder region upon which the device is supported, and such tilting will correspondingly be resisted by the portions of the limbs 3 extending laterally past the waist of the wearer.

Figure 4:
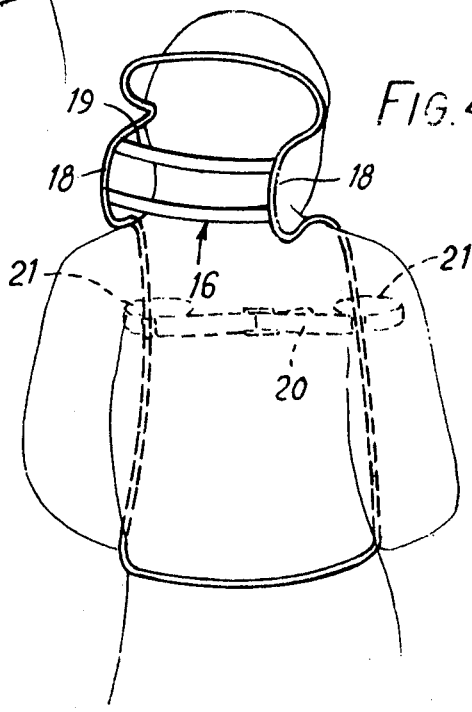
FIG. 4 is a view similar to FIG. 3 of another embodiment of the invention.

Referring to FIG. 4, there is shown a further embodiment of the invention, wherein the loops 6 in the limbs 3 are replaced by shallower loops 18, between which extend transverse straps 16 and 19 serving as a further backrest for the child, the strap 16 additionally assisting location of the device on the adult's shoulders.

It will thus be seen that in accordance with the invention there is provided a lightweight and simple structure which effectively provides support needed by a child to be carried piggy-back fashion, without the requirement for a cumbersome framework to be supported on the back of the wearer by means of a shoulder harness or the like.

Whilst embodiments of the invention have been described in detail above, it will be appreciated that various modifications and alterations may be made without departing from the scope of the invention as defined in the appended claims. Thus, although in the illustrated embodiment the device comprises a simple wire framework, additional reinforcement may be provided as necessary, for example to increase the area of the backrest and provide greater security for the child, or to increase the area of contact with the body of the adult for greater comfort. Instead of being formed from wire, the device could be formed by injection molding from suitable synthetic plastics material of appropriate cross section. Moreover, provided that the essential lever function of the lever system interconnecting the backrest and the bracing means is retained, the device may be formed with joints or flexible portions to enable it to be folded into a smaller space for storage.

Furthermore, although in the illustrated embodiment the device shown is self supporting without the aid of any shoulder harness, additional straps may be provided as desired; for example an adjustable chest strap 20 may be arranged to interconnect the frontal regions of the limbs 3 and to pass across the chest of the wearer. Loops 21 might also be provided for holding the legs or ankles of the child, whereby the child can obtain a purchase to assist itself in balancing on the adult's shoulders.

I claim:

1. A device to be worn by an individual for use in supporting a child or infant to be carried seated on the shoulders of the wearer, comprising rigid bracing means extending about the rear waist portion of the torso of the wearer, a pair of spaced relatively rigid limbs integral with and extending upwardly and forwardly from said bracing means to pass below the upper portion of the arms and across the sides of the wearer, across the frontal shoulder region of the wearer's body, and then rearwardly and upwardly over the shoulders and down the back of the wearer's rear shoulder region whereby said rigid limb structure snugly embraces the shoulder, rigid integral portions of said limbs extending upwardly from the rear shoulder region, and rigid backrest means for the child integrally interconnecting the upper ends of said upwardly extending portions behind the wearer, whereby said limbs and upwardly extending portions comprise the sole rigid connection between said bracing means and said backrest and form a lever system having a fulcrum at the shoulder region of the wearer's body, and rearward forces placed upon the said backrest means by the child tend to exert a turning moment about said lever system which is resisted by the engagement of said bracing means against the rear waist portion of the torso.

2. A device to be worn by an individual for use in supporting a child or infant to be carried seated on the shoulders of the wearer, said device comprising backrest means adapted to provide support for the child or infant, bracing means for location against the rear portion of the torso of the wearer of the device, and means interconnecting said backrest means and said bracing means and adapted to be supported on the torso of the wearer, said interconnecting means comprising two spaced limbs arranged to extend from said bracing means on each side of the torso, forwardly and thence upwardly in front of the shoulder region of the wearer, the improvement comprising extending said bracing means across the rear portion of the torso between the lower extremities of said two spaced limbs, and in which said limbs are sufficiently rigid to form a lever structure, whereby the frontal shoulder region of the wearer's body forms a fulcrum for said lever structure and rearward forces placed upon said backrest means by the child tend to exert a turning moment upon said lever structure which is resisted by the engagement of said bracing means against the rear of the torso.

3. A device accordng to claim 2, in which said limbs are shaped to conform to the anatomy of the adult and include portions curved to extend over the tops of the shoulders in order to provide vertical support for the device, whereby the top of each shoulder forms a further fulcrum for the lever structure and the lateral forces placed on said backrest means exert a turning moment which is resisted by engagement of the lever structure against the lateral portion of the torso below the wearer's arms.

4. A device according to claim 1, in which said backrest, said bracing means and said limbs are formed integrally as a substantially rigid framework.

5. A device according to claim 2, in which said backrest, said bracing means and said limbs are formed integrally as a substantially rigid framework.

6. The improvement according to claim 1, wherein said limbs are shaped to conform to the anatomy of the adult and include portions curved to extend over the tops of the shoulders in order to provide vertical support for the device, the arrangement further being such that the top of each shoulder forms a further fulcrum for the lever system whereby lateral forces placed on said backrest means exert a turning moment which is resisted by engagement of the lever system against the lateral portion of the torso below the wearer's arms.

7. The device according to claim 6, in which said backrest and said bracing means and said lever system are formed integrally as a substantially rigid framework.

8. A device accordng to claim 1, in combination with a chest strap adapted to interconnect said limbs against the chest of the wearer.

9. A device according to claim 1, further comprising loops attached to said limbs positioned to receive the legs of the child.

* * * * *